US006930284B2

(12) United States Patent
Kang

(10) Patent No.: US 6,930,284 B2
(45) Date of Patent: Aug. 16, 2005

(54) SAFETY DEVICE OF ELECTRIC OVEN

(75) Inventor: Myeong Yeol Kang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/734,255

(22) Filed: Dec. 15, 2003

(65) Prior Publication Data

US 2004/0169031 A1 Sep. 2, 2004

(30) Foreign Application Priority Data

Dec. 18, 2002 (KR) ..... 10-2002-0081320

(51) Int. Cl.[7] ..... F24C 15/02; A21B 3/02
(52) U.S. Cl. ..... 219/391; 126/197; 99/337
(58) Field of Search ..... 219/391, 393, 219/412–414, 724, 739; 126/197; 99/337

(56) References Cited

U.S. PATENT DOCUMENTS 3,451,389 A * 6/1969 Huff ..... 126/197
3,462,584 A * 8/1969 Guy ..... 219/412
3,474,226 A * 10/1969 Kauranen ..... 219/413
3,894,214 A 7/1975 Staples
4,082,078 A * 4/1978 Thuleen et al. ..... 126/197
4,825,027 A * 4/1989 Yoon ..... 219/724
6,147,622 A * 11/2000 Fonea ..... 340/5.2

FOREIGN PATENT DOCUMENTS

| | | | |
|---|---|---|---|
| CH | 601736 A | * | 7/1978 |
| DE | 1900828 A | | 10/1969 |
| DE | 29620664 | | 4/1997 |
| DE | 19705821 | | 7/1998 |
| EP | 1388604 A1 | | 2/2004 |
| FR | 2521274 A | * | 8/1983 |
| WO | WO 00/52392 A | | 9/2000 |

* cited by examiner

*Primary Examiner*—Joseph Pelham
(74) *Attorney, Agent, or Firm*—Birch, Stewart, Kolasch & Birch, LLP

(57) ABSTRACT

A safety device of an electric oven is disclosed, which is provided to prevent a door from being open when a temperature inside an oven cavity is high. The safety device includes a hole provided in a front part of an oven cavity forming a cooking room therein; a latch protruding from an inner side of a door opening/closing the oven cavity, for being inserted into the hole when the door is closed; a rotation motor provided in an upper part of the oven cavity; a lever rotatably coupled with an axis of the rotation motor; and a temperature sensor measuring a temperature inside the oven cavity.

13 Claims, 5 Drawing Sheets

SAFETY DEVICE OF ELECTRIC OVEN

This application claims the benefit of the Korean Application No. P2002-0081320 filed on Dec. 18, 2002, which is hereby incorporated by reference.

BACKGROUND OF THE INVENTION

1. Field of the Invention

The present invention relates to an electric oven, and more particularly, to a safety device of an electric oven, for controlling opening/closing of a door according to a temperature inside a cavity.

2. Discussion of the Related Art

In general, an electric oven cooks food, not by burning gas like a gas oven, but by elevating a temperature inside of the oven with electricity or by directing a microwave to the food. The electric oven is favored by consumers in light of no generation of flame, and no gas leakage hazard, leading to cause less accidents coming from negligence of safety than the gas oven.

In the meantime, the electric oven is provided with components, such as a heater and a magnetron, and the like for heating the food. The heater is provided in an upper side or a lower side of a cooking room for heating the food when power is provided thereto. However, since the heater generates a high temperature, the inside of the cooking room is maintained at the high temperature during operation of the electric oven. Accordingly, when a door is open during operation of the electric oven, users, especially, children may be burnt. In this respect, it is required to prevent the door from being open when the inside of the cooking room is in high temperature during operation of the electric oven, so as to prevent accidents such as burn.

SUMMARY OF THE INVENTION

Accordingly, the present invention is directed to a safety device of an electric oven that substantially obviates one or more problems due to limitations and disadvantages of the related art.

An object of the present invention is to provide a safety device of an electric oven to prevent a door from being open when a temperature inside an oven cavity is high.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a safety device of an electric oven includes a hole provided in a front part of an oven cavity forming a cooking room therein; a latch protruding from an inner side of a door opening/closing the oven cavity, for being inserted into the hole when the door is closed; a rotation motor provided in an upper part of the oven cavity; a lever rotatably coupled with an axis of the rotation motor; and a temperature sensor measuring a temperature inside the oven cavity.

At this time, the rotation motor is formed of a step motor, and the temperature sensor is provided inside the oven cavity. Also, the lever is formed in a plate shape having one end curved downwardly.

Further, the safety device includes a sensing part provided in an upper part of the oven cavity so as to sense the movement of the lever. Also, the sensing part includes a switch generating a signal of controlling the rotation motor, in a method of being in contact with a lower part of the lever when the lever is rotated downwardly and coupled with the latch.

At this time, a protruding portion is provided in the lower part of the lever for being in contact with the switch of the sensing part.

Meanwhile, the safety device further includes a plate provided in an upper part of the oven cavity, having a rotation motor in a lateral part thereof; and a stopper protruding from an upper end of the plate toward the lever so as to prevent the lever from being elevated above a predetermined angle.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, an electric oven according to the present invention will be described with reference to the accompanying drawings.

Figure 1:
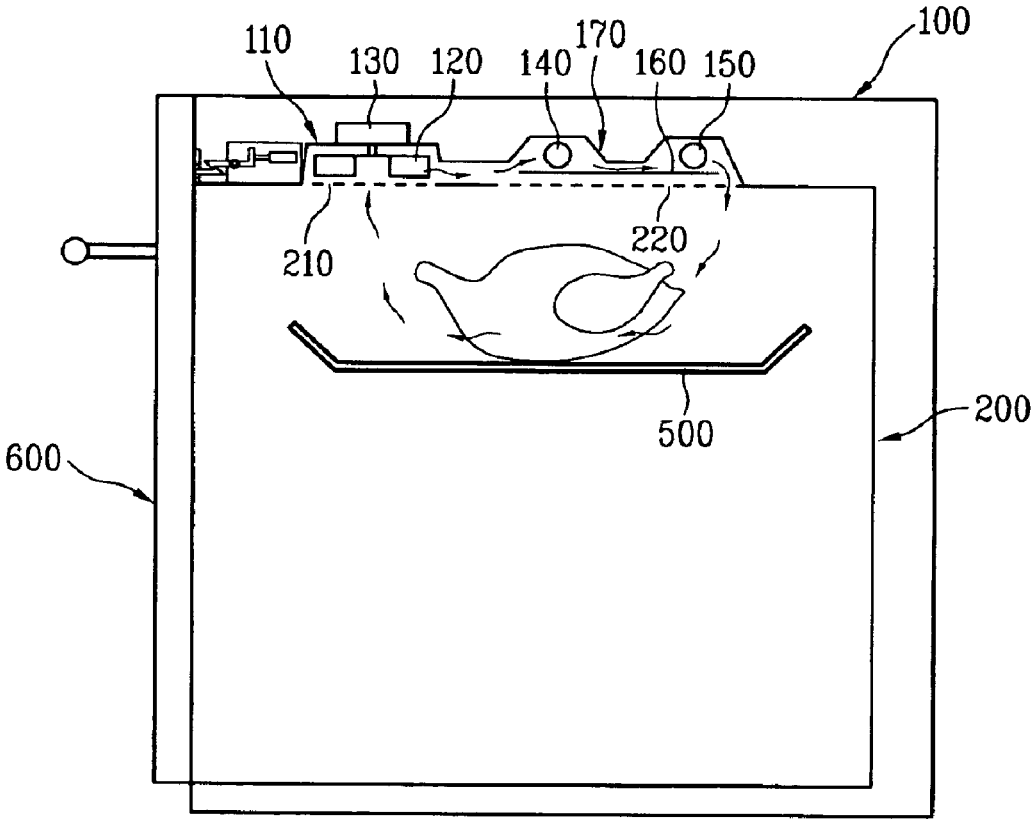
FIG. 1 is a cross-sectional view illustrating an electric oven according to the first embodiment of the present invention.

FIG. 1 is a cross-sectional view illustrating an electric oven according to the first embodiment of the present invention. As shown in FIG. 1, the electric oven according to the first embodiment of the present invention includes a case 100 forming the external of the electric oven, an oven cavity 200 forming a cooking room of receiving food in the case 100, and a door 600 for opening/closing the cooking room inside the oven cavity 200.

In this state, an air outlet hole 210 and an air inlet hole 220 are provided in an upper part of the oven cavity 200. Also, a fan housing 110 is provided corresponding to the air outlet hole 210. In the fan housing 110, there are a centrifugal fan 120, and a fan motor 130 for driving the centrifugal fan 120. Then, a ceramic heater 140 and a halogen heater 150 are provided corresponding to the air inlet hole 220 so as to heat the inside of the cooking room. At this time, a sheath grill heater 160 is provided along an upper side of the air inlet hole 220 below the ceramic heater 140 and the halogen heater 150, and a heater cover 170 is provided along an upper side of the heaters 140 and 150 for being connected with the fan housing 110.

Meanwhile, a temperature sensor 500 is provided inside the oven cavity 200. Then, a safety device is provided in an upper front part of the oven cavity 200 so as to control opening/closing of the door 600 in case of that a temperature inside the oven cavity rises above a predetermined degree.

Figure 2:
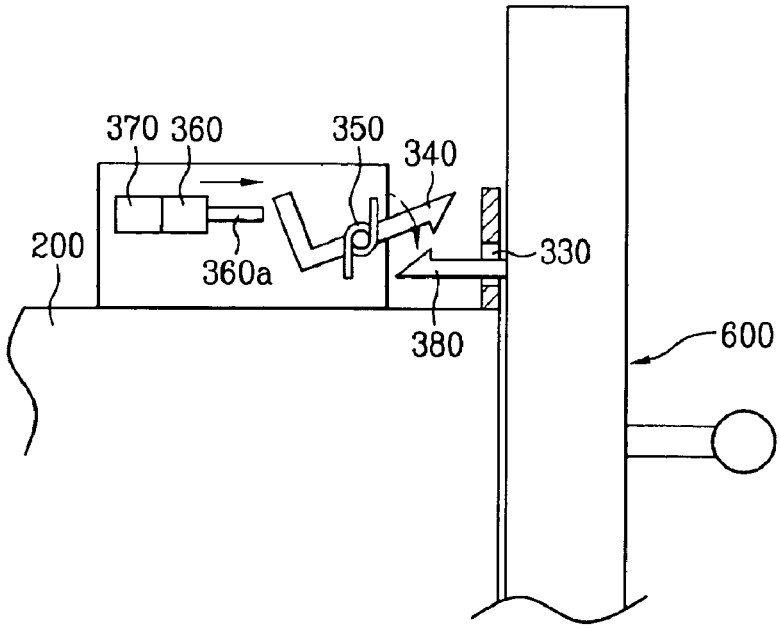
FIG. 2 and FIG. 3 are cross-sectional views schematically illustrating a structure of a safety device and its operation according to the first embodiment of the present invention.
Figure 3:
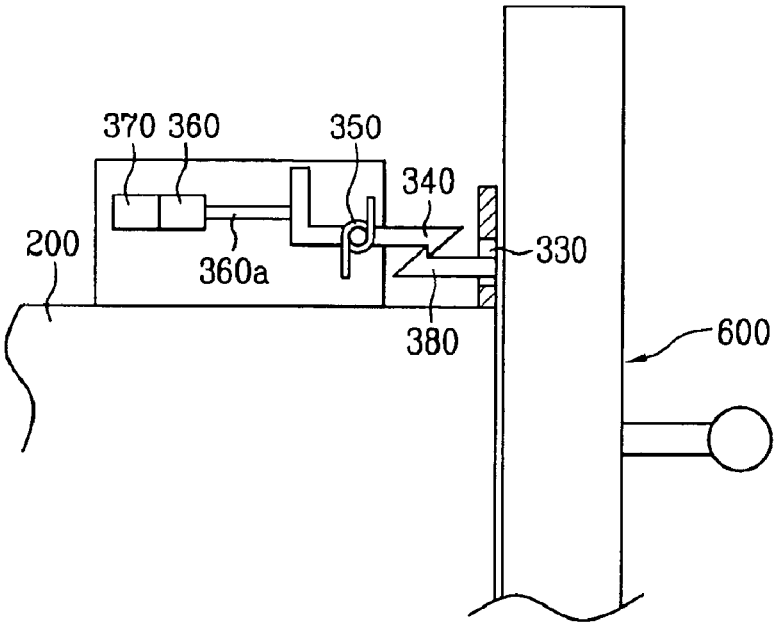

A structure and operation of a safety device in the electric oven according to the first embodiment of the present invention will be described as follows. FIG. 2 and FIG. 3 are cross-sectional views schematically illustrating a structure of a safety device and its operation according to the first embodiment of the present invention.

As shown in FIG. 2, the safe device of the electric oven is provided with a first hook 380 in an upper rear part of the door 600, an insertion hole 330 in an upper front part of the oven cavity 200, and a second hook 340 in an upper part of the oven cavity 200. In this state, the second hook 340 is hinged rotatably, and restored elastically with a spring 350. Also, a hydraulic cylinder 360 including a cylinder axis 360*a* and a heat resistance 370 is provided in the rear part of the second hook 340. The heat resistance 370 generates hydraulic pumping power by heating, so as to move the cylinder axis 360*a*.

An operation of the safety device in the electric oven will be described in detail.

On operation mode of the electric oven, the temperature sensor 500 measures the temperature inside the oven cavity 200, and transmits the measured temperature to a controller (not shown). At this time, if the measured temperature inside the oven cavity 200 is above the predetermined degree, the heat resistance 370 is heated under control of the controller (not shown).

As the cylinder axis 360*a* is forwardly moved by the pumping power generated from the heat resistance 370, as shown in FIG. 2, the second hook 340 is rotatably moved by the hydraulic cylinder 360. Accordingly, referring to FIG. 3, the second hook 340 is coupled with the first hook 380, whereby it is possible to prevent the door 600 from being open freely.

Figure 4:
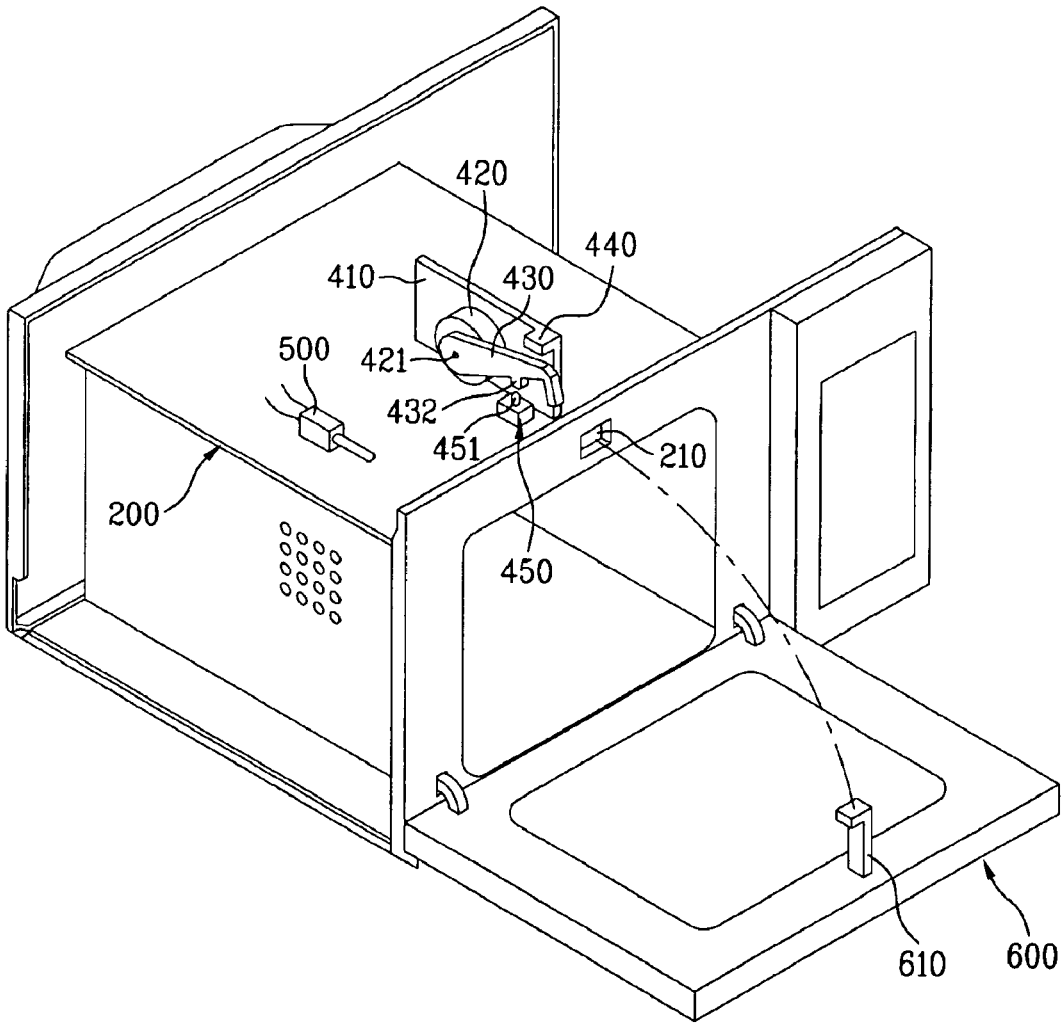
FIG. 4 is a perspective view schematically illustrating an inner structure of an electric oven according to the second embodiment of the present invention.

FIG. 4 is a perspective view illustrating an inner structure of an electric oven according to the second embodiment of the present invention. As shown in FIG. 4, a safety device of the electric oven according to the second embodiment of the present invention includes a hole 210 provided in an oven cavity 200, a latch 610 provided in a door 600, a locking means provided in an upper part of the oven cavity 200, and a temperature sensor 500.

At this time, the oven cavity 200 is provided with a cooking room, and the hole 210 penetrating a front side of the oven cavity 200. Also, the door 600 is provided in the front of the oven cavity 200, for opening/closing the cooking room inside the oven cavity 200. The latch 610 protrudes from an inner surface of the door 600. That is, the latch 610 is inserted into the hole 210 when the door 600 is closed. Herein, an end of the latch 610 is formed in a curved shape of "⌉" or "∩".

Next, the locking means is provided with a rotation motor 420, a lever 430 and a sensing part 450. At this time, the rotation motor 420 is provided in an upper part of the oven cavity 200, and an axis 421 of the rotation motor 420 is protruded in left or right from a front-side direction. Also, the rotation motor 420 may be provided in a lateral part of the oven cavity 200, and the protruding direction of the axis 421 may be varied according to the position of the rotation motor 420. Preferably, the rotation motor 420 is formed of a step motor, rotating the axis 421 at a predetermined angle in a method of generating a pulse signal by pressure. Then, the lever 430 is formed in a plate shape having an end curved downwardly, and the lever 430 is coupled with the latch 610 so as to prevent the door 600 from being open.

Figure 5:
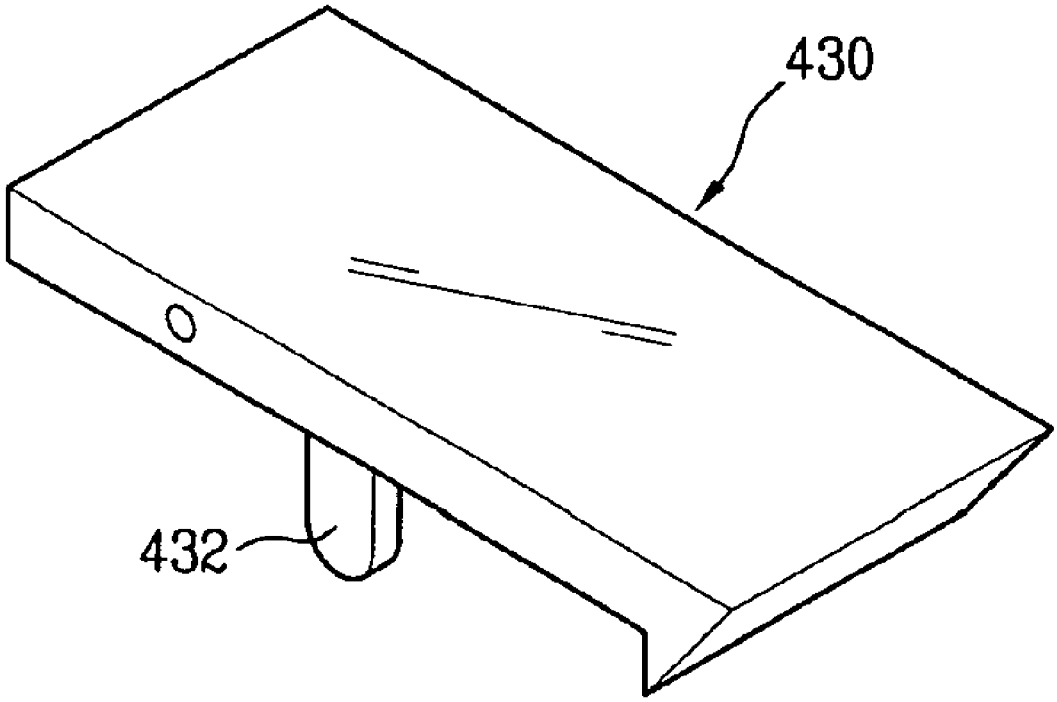
FIG. 5 is a perspective view illustrating a lever according to another embodiment of the present invention.

FIG. 5 is a perspective view illustrating a lever according to another embodiment of the present invention. The lever 430 may be formed in various shapes. For example, as shown in FIG. 4, the lever 430 is formed in the thin plate type. Meanwhile, as shown in FIG. 5, the lever 430 is formed in the thick plate type. At this time, the lever 430 is coupled with the axis 421 of the rotation motor 420, whereby the lever 430 is rotated upwardly and downwardly according to an operation of the rotation motor 420.

The sensing part 450 is provided in the upper part of the oven cavity 200 so as to sense the lever 430. For this, the sensing part 450 is provided in a lower side of the lever 430 at a predetermined interval from the lever 430. When the lever 430 is rotated downwardly, and coupled with the latch 610 according as the rotation motor 420 is driven, a switch 451 of the sensing part 450 is in contact with a lower part of the lever 430. At this time, the switch 451 provides a signal for controlling the driving of the rotation motor 450 to the controller. It is preferable to form a downward protruding portion 432 in the lower part of the lever 430 for an accurate contact.

Meanwhile, a fixing plate 410 may be provided in the upper part of the oven cavity 200, to which the rotation motor 420 is provided. The lower part of the fixing plate 410 is fixed to the upper part of the oven cavity 200. Also, the fixing plate 410 has the rotation motor 420 fixed to one lateral side thereof. Then, a stopper 440 is provided in an upper part of the fixing plate 410. That is, the stopper 440 protrudes from one end portion of the upper part of the fixing plate 410 toward the lever 430, so as to prevent the lever 430 from being elevated above a predetermined angle, whereby the lever 430 is operated stably.

The temperature sensor 500 measures the temperature inside the oven cavity 200, and provides the measured value to the controller. Preferably, the controller is formed of a micom controlling the overall operation of the electric oven. Meanwhile, as shown in FIG. 4, the temperature sensor 500 may be provided in the inside or the lateral part of the oven cavity 200 as well as the upper part of the oven cavity 200.

Figure 6:
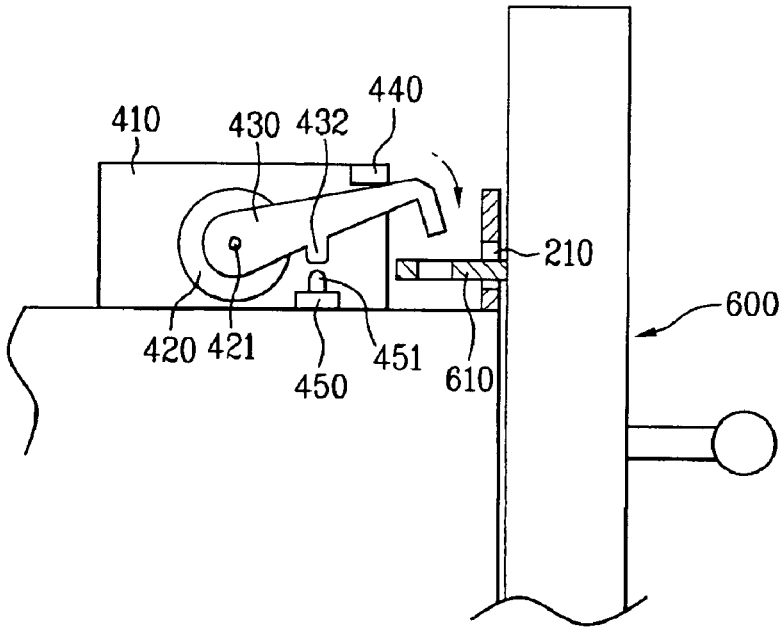
FIG. 6 and FIG. 7 are cross-sectional views schematically illustrating operation of a safety device according to the second embodiment of the present invention.
Figure 7:
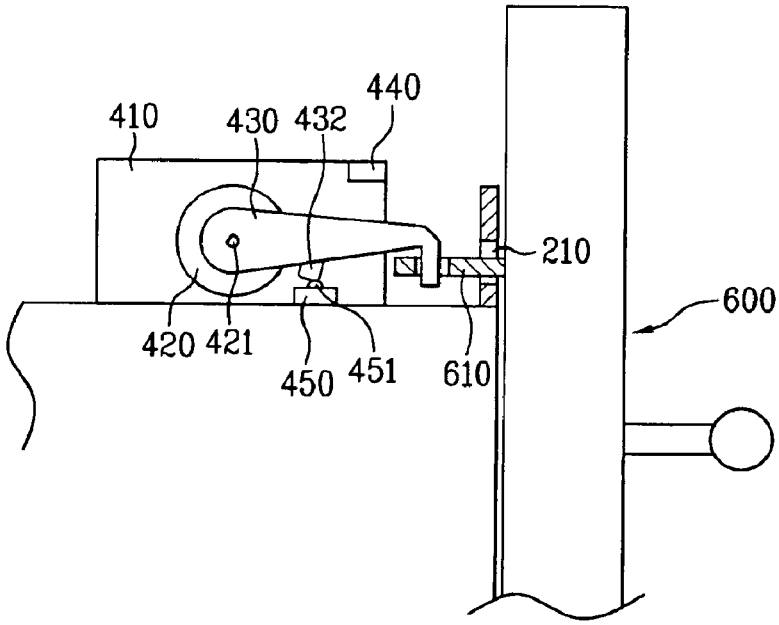

Hereinafter, an operation of the safety device in the electric oven according to the second embodiment of the present invention will be described with reference to FIG. 6 and FIG. 7. FIG. 6 and FIG. 7 are cross-sectional views schematically illustrating the operation of the safety device in the electric oven according to the second embodiment of the present invention.

As shown in FIG. 6, on the initial operation of the electric oven, even though the cooking room inside the oven cavity 200 is sealed with the door 300, the lever 430 is apart from the latch 610 at a predetermined interval. That is, the curved end of the lever 430 is positioned above the latch 610, so that the door 600 may be open or closed freely.

After that, on the cooking operation for the food by heat and convection current from a heater, the controller checks the temperature inside the oven cavity 200 with the temperature sensor 500. At this time, if the checked temperature value inside the oven cavity 200 is higher than the predetermined degree of the controller, the controller controls the rotation motor 420 such that the lever 430 is rotated downwardly. Herein, the predetermined degree is the temperature dangerous for a user when the door 600 of the electric oven is open.

Referring to FIG. 7, according to the operation of the rotation motor 420, the downward curved end of the lever 430 is moved downwardly for being coupled with the latch 610. When the lever 430 is moved downwardly, the downward protruding portion 432 provided in the lower part of the lever 430 is in contact with the switch 451 of the sensing part 450, thereby turning-on the sensing part 450, and providing the status signal to the controller.

After the controller receives the status signal from the sensing part 450, the controller stops the rotation of the lever 430 by controlling the rotation motor 420. Accordingly, it is maintained that the lever 430 is coupled with the latch 610, whereby it is possible to prevent the door 600 from being open. In a state of coupling the lever 430 with the latch 610, the inner temperature of the oven cavity 200, checked by the temperature sensor 500, is continuously provided to the controller. If the checked temperature inside the oven cavity 200 is lower than the predetermined degree, the controller controls the rotation motor 420 such that the lever 430 is rotated upwardly, whereby it is possible to open the door 600.

As mentioned above, the electric oven according to the present invention has the following advantages.

In the electric oven according to the first and second embodiments of the present invention, the safety device is provided so as to prevent the door from being open in case of that the temperature inside the oven cavity is high, thereby preventing accidents by the high temperature in the oven cavity.

Also, the safety device according to the second embodiment of the present invention has the simple structure using the rotation motor and the lever, so that it is possible to decrease the manufacturing cost.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A safety device of an electric oven comprising:

a hole provided in a front part of an oven cavity forming cooking room therein;

a latch protruding from an inner side of a door opening/closing the oven cavity, for being inserted into the hole when the door is closed;

a rotation motor provided in an upper part of the oven cavity;

a lever rotatably coupled with an axis of the rotation motor; and a temperature sensor measuring a temperature inside the oven cavity, wherein the rotation motor is formed of a step motor.

2. The safety device as claimed in claim 1, wherein the temperature sensor is provided inside the oven cavity.

3. The safety device as claimed in claim 1, wherein the lever is formed in a plate shape having one end curved downwardly.

4. The safety device as claimed in claim 1, further comprising a sensing part provided in an upper part of the oven cavity so as to sense the movement of the lever.

5. The safety device as claimed in claim 4, wherein the sensing part includes a switch generating a rotation motor control signal by being in con contact with a lower part of the lever when the lever is rotated downwardly and coupled with the latch.

6. A safety device of an electric oven comprising:

a hole provided in front part of an oven cavity forming a cooking room therein;

a latch protruding from an inner side of a door opening/closing the oven cavity for being inserted into the hole when the door is closed;

a rotation motor provided in an upper part of the oven cavity;

a lever rotatably coupled with an axis of the rotation motor;

a temperature sensor measuring a temperature inside the oven cavity; and a sensing part provided in an upper part of the oven cavity so as to sense the movement of the lever;

wherein the sensing part includes a switch generating a rotation motor control signal by being in contact with a lower part of the lever when the lever is rotated downwardly and coupled with the latch, and wherein a protruding portion is provided in the lower par of the lever for being in contact with the switch of the sensing part.

7. A safety device of an electric oven comprising:

a hole provided in a front part of an oven cavity forming a cooking room therein;

a latch protruding from an inner side of a door opening/closing the oven cavity, for being inserted into the hole when the door is closed;

a rotation motor provided in an upper part of the oven cavity;

a lever rotatably coupled with an axis of the rotation motor;

a temperature sensor measuring a temperature inside the oven cavity;

a plate provided in an upper part of the oven cavity, having the rotation motor in a lateral part thereof; and a stopper protruding from an upper end of the plate toward the lever so as to prevent the lever from being elevated above a predetermined angle.

8. The safety device as claimed in claim 7, wherein the rotation motor is formed of a step motor.

9. The safety device as claimed in claim 7, wherein the temperature sensor is provided inside the oven cavity.

10. The safety device as claimed in claim 7, wherein the lever is formed in a plate shape having one end curved downwardly.

11. The safety device as claimed in claim 7, further comprising a sensing part provided in an upper part of the oven cavity so as to sense the movement of the lever.

12. The safety device as claimed in claim 11, wherein the sensing part includes a switch generating a signal of controlling the rotation motor, in a method of being in contact with a lower part of the lever when the lever is rotated downwardly and coupled with the latch.

13. The safety device as claimed in claim 12, wherein a protruding portion is provided in the lower part of the lever for being in contact with the switch of the sensing part.

* * * * *